United States Patent [19]

Nakase

[11] Patent Number: 5,061,939

[45] Date of Patent: Oct. 29, 1991

[54] FLAT-PLATE ANTENNA FOR USE IN MOBILE COMMUNICATIONS

[75] Inventor: Kazuhiko Nakase, Tokyo, Japan

[73] Assignee: Harada Kogyo Kabushiki Kaisha, Tokyo, Japan

[21] Appl. No.: 527,126

[22] Filed: May 22, 1990

[30] Foreign Application Priority Data

May 23, 1989 [JP] Japan ..... 1-129863

[51] Int. Cl.[5] ..... H01Q 1/27; H01Q 1/32

[52] U.S. Cl. ..... 343/700 MS; 343/846; 343/829

[58] Field of Search ..... 343/700 MS, 725, 749, 343/846, 848, 829, 830, 711, 712, 713

[56] References Cited

U.S. PATENT DOCUMENTS 4,724,443 2/1988 Nysen ..... 343/700 MS 4,791,423 12/1988 Yokoyama et al. ..... 343/700 MS 4,827,266 5/1989 Sato et al. ..... 343/700 MS 4,907,006 3/1990 Nishikawa et al. ..... 343/700 MS

*Primary Examiner*—Michael C. Wimer

*Assistant Examiner*—Hoanganh Le

*Attorney, Agent, or Firm*—Koda and Androlia

[57] ABSTRACT

A flat-plate antenna for use in mobile communications including a ground plate, a table-shape frame made up with a conductive top plate and connecting members which electrically connect the top plate to the ground plate, a capacitor electrode installed between the top plate and ground plate so as to resonate the table shape frame, and a strip line resonator installed under the table shape frame and is provided with a capacitor electrode for resonating the strip line resonator, the capacitor electrode being positioned beneath the central area of the top plate.

18 Claims, 5 Drawing Sheets

FLAT-PLATE ANTENNA FOR USE IN MOBILE COMMUNICATIONS

BACKGROUND OF THE INVENTION

1. Field of the Invention

The present invention relates to a flat-plate antenna used in mobile communications and more particularly to a flat-plate antenna mounted to a vehicle body and used for automobile telephones of MCA (multi-channel access), etc.

2. Prior Art

Various types of wire-form antennas have conventionally been used as automobile communication antennas. The reason for this is that wire-form antennas have maximum radiating characteristics in the horizontal direction (which is required for mobile communications) and can easily be endowed with characteristics which are non-directional in a horizontal plane.

Furthermore, antennas used for automobile telephones and MCA require broad-band characteristics, and for the wire-form antennas, techniques for obtaining such broad-band characteristics have been established so that such demands can be met relatively easily in antenna development and design.

In recent years, flat-plate antennas have attracted attention as antennas for mobile communications. The reason for this is that such antennas provide very considerable operating merits.

More specifically, when a flat-plate antenna is attached to an automobile, there is no projected object on a vehicle; accordingly, there is no deleterious effect on the style of the vehicle. Furthermore, wind noise is remarkably reduced during the operation of the vehicle, and antenna damage is less likely to occur since there is no danger for the flat-plate antenna to contact with car wash machinery, garages, roadside trees, etc.

When flat-plate antennas are used, the antennas must have broad-band characteristics. For this reason, antennas having multi-layer structures have been proposed. However, since such proposed antennas are too complex in structure to be formed in an integral unit, it has been difficult to commercialize the antennas.

SUMMARY OF THE INVENTION

Accordingly, it is the main object of the present invention to provide a flat-plate antenna for use in mobile communications, in which the antenna as a whole is compact in size, has sufficient broad-band characteristics and is simple in structure.

In the antenna of the present invention, a plurality of connecting elements are used to electrically connect a conductive flat-plate to a ground plate. Capacitor electrodes used for table type antenna resonance are installed between the flat-plate and the ground plate in a manner that each capacitor electrode is positioned between the connecting elements. In addition, a strip line resonator is provided between the flat-plate and the ground plate, and a capacitor electrode used for strip line resonance is attached to the strip line resonator so as to be under the center of the flat-plate.

Thus, the antenna of the present invention includes a table type antenna (made up with the flat-plate, connecting members and a ground plate), and capacitor electrodes used for antenna resonance, a strip line resonator, and a capacitor electrode used for strip line resonance are all provided under the table type antenna. Accordingly, the overall size can be small, and the structure can be simple, still having sufficient broad-band characteristics.

BRIEF DESCRIPTION OF THE DRAWINGS

FIG. 1(2) is a sectional view taken along the line II—II of FIG. 1(1);

FIG. 1(3) is a sectional view taken along the line III—III of FIG. 1(1);

FIG. 1(4) is an equivalent circuit of the antenna of FIG. 1(1);

FIG. 2(2) is an equivalent circuit diagram which shows impedance characteristics in the vicinity of the resonance frequency as viewed from the center of the circular plate in FIG. 2(1);

FIG. 3(2) is an equivalent circuit diagram illustrating the impedance characteristics as viewed from the feeding point of the feeder line in the embodiment of FIG. 3(1);

FIG. 4(2) is a front view thereof with the connecting parts and capacitor electrode omitted;

DETAILED DESCRIPTION OF THE INVENTION

Figure 1:
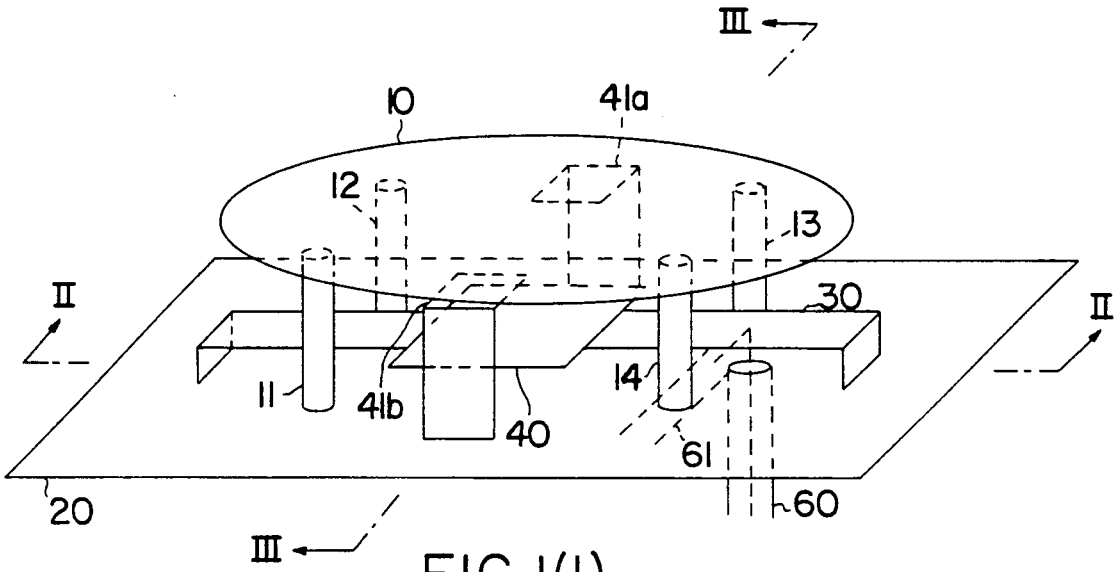
FIG. 1(1) is an overall perspective view of the antenna in accordance with the present invention.
Figure 1:
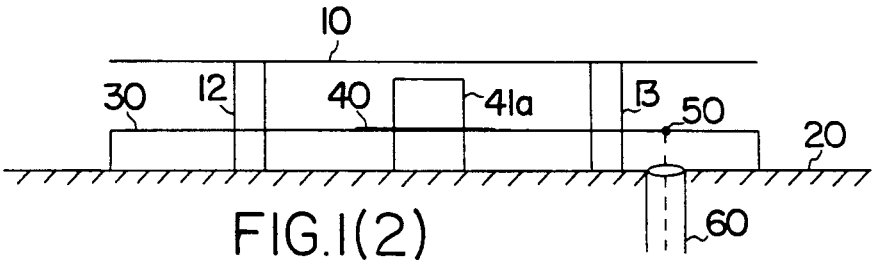
Figure 1:
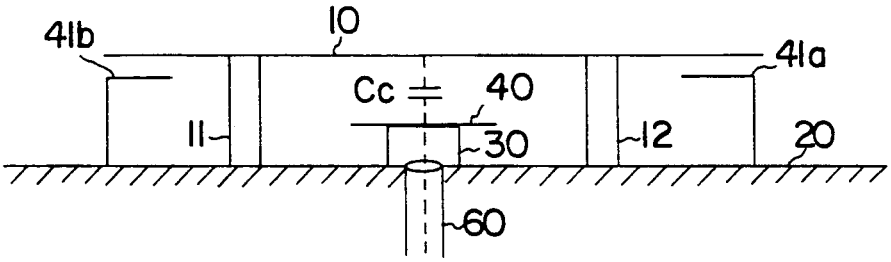

As seen from FIG. 1(1), the table type antenna of the present invention includes the following elements: a table type or table shape antenna 10; a ground plate 20 provided below the antenna 10; a strip line resonator 30 installed under the table type antenna 10 (in other words, the resonator 30 is between the antenna 10 and the ground plate 20); a capacitor electrode 40 used for strip line resonance and installed on the strip line resonator 30 so that the electrode 40 is positioned underneath the central area of the table type antenna 10; capacitor electrodes 41*a* and 41*b* used for table type antenna resonance; and a feeder line 60 which has a feeding point 50 on the strip line resonator 30.

The table type antenna 10 includes a conductive flat-plate or top-plate in circular shape and a plurality of connecting members 11, 12, 13 and 14 which connect the flat-plate (top-plate) to the ground plate 20. The antenna is excited in the monopole mode.

Both ends of strip line resonator 30 are grounded or connected to the ground plate 20. This strip resonator 30 acts as an impedance transformer.

The capacitor electrode 41*a* used for table type antenna resonance is installed between the connecting elements 12 and 13 and between the flat-plate of the antenna 10 and the ground plate 20. The capacitor electrode 41*b* used for table type antenna resonance is installed between the connecting members 11 and 14 and between the flat-plate of the antenna 10 and the ground plate 20.

The electrostatic capacitance Cc between the capacitor electrode 40 and the table type antenna 10 is indicated by the capacitor symbol in FIG. 1(3).

In FIG. 1(1), the feeder line 60 is brought from the bottom of the ground plate 20 (so that the feeder line 60 is perpendicular to the ground plate 20); however, the feeder line 60 can be installed so that it is parallel to the ground plate 20 as indicated by the reference numeral 61.

Figure 2:
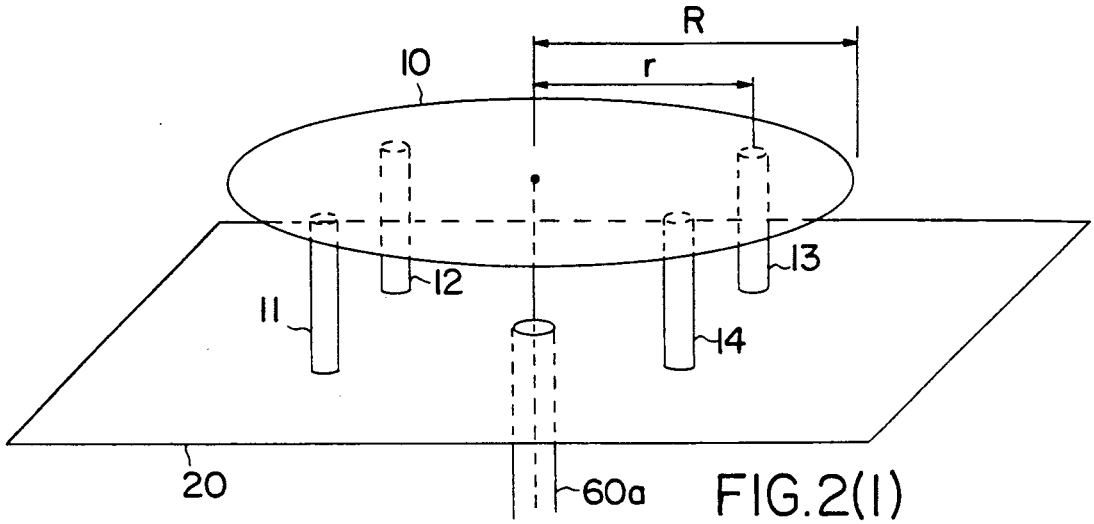
FIG. 2(1) is an explanatory diagram illustrating the antenna of FIG. 1(1) operating in a monopole mode.
Figure 2:
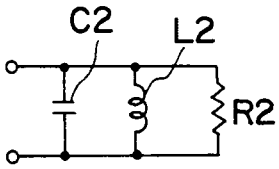

FIG. 2(1) illustrates the relationship between the table type antenna 10 (excited in the monopole mode) and the feeder line 60.

If the table type antenna 10 is excited in the monopole mode (i.e., in cases where the current flowing through the flat plate flows uniformly from the center of the flat-plate toward the periphery) and the flat-plate antenna is excited in the lowest-order mode ($\lambda/2$), the voltage distribution reaches its maximum in the central area of the table type antenna 10. Accordingly, in the vicinity of the resonance frequency, the impedance characteristics (when seen from the center of the circular plate) may be viewed as a parallel resonance circuit as shown in FIG. 2(2).

Furthermore, with the capacitor electrodes 41*a* and 41*b* provided for the table type antenna resonance, it is possible to make the flat-plate antenna for use in mobile communications much more compact.

If the connecting elements 11 through 14 are provided inside the edge of the table type antenna 10, the impedance value measured at the time when the antenna is resonating (the value of R2 in FIG. 2(2)) will be small. Thus, the impedance R2 can be changed by shifting the installation positions of the connecting elements 11 through 14 inwardly until a desired broad band width is obtained.

Since the resonance frequency of the antenna increases as the installation positions of the connecting elements 11 through 14 are moved inward, the resonance frequency of the antenna can be adjusted to a desired frequency by using the electrostatic capacitance of the capacitor electrodes 41*a* and 41*b* to lower the resonance frequency.

Figure 3:
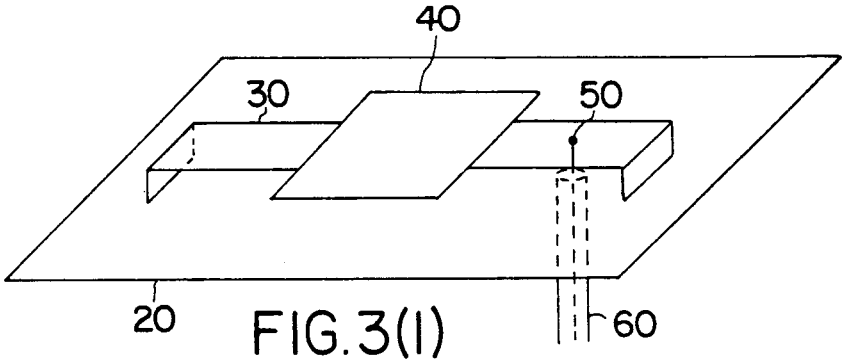
FIG. 3(1) is a perspective view illustrating the strip line resonator used in the antenna of FIG. 1(1)
Figure 3:
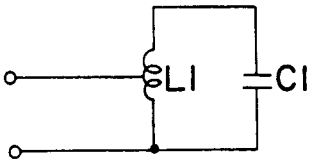

FIG. 3(1) is a detailed illustration of the strip line resonator 30 which has both ends grounded and is equipped with the capacitor electrode 40 in the above embodiment.

When the resonator of FIG. 3(1) is resonating in the lowest-order mode ($\lambda/2$), the voltage reaches its maximum in the area of the capacitor electrode 40. Accordingly, in the vicinity of the resonance frequency, the impedance characteristics, when seen from the feeding point 50 of the feeder line 60, may be viewed as a parallel resonance circuit with a tap as shown in FIG. 3(2).

The embodiment illustrated in FIG. 1(1) and 1(2) may be viewed as a combination of the table type antenna 10 of FIG. 2(1) and the strip line resonator of FIG. 3(1) with the feeder line 60*a* shown in FIG. 2(1) omitted and the feeder line 60 shown in FIG. 3(1) is used instead.

As a result, a primary resonance circuit formed by the strip line resonator 30 and a secondary resonance circuit formed by the table type antenna 10 are electrostatically coupled by the electrostatic capacitance Cc which is between the electrode plates. Thus, in the embodiment illustrated in FIG. 1(1), a double tuning circuit based on the capacitive coupling is formed (in apparent terms) in the vicinity of the resonance frequency as shown in FIG. 1(4).

In this case, the resonance frequency on the primary side and the resonance frequency on the secondary side are tuned to the frequency used, the coupling capacitance Cc is set at the critical coupling value, and the position of the feeding point 50 is selected so that the impedance of the flat-plate antenna for use in mobile communications (shown in FIG. 1) and the impedance of the feeder line are in a matched state. As a result, the reflection loss of the flat-plate antenna for use in mobile communications shown in FIG. 1(1) can be reduced, and a good VSWR value can be obtained across the broad-band.

Meanwhile, necessary conditions for flat-plate antennas used in mobile communications (e.g., automobile telephones, etc.) are that the antenna is superior in terms of: (a) directional characteristics (a feature of antennas to have maximum radiating characteristics in the horizontal direction and be non-directional within the horizontal plane); (b) broad-band characteristics (a feature for antennas for automobile telephones to cover the 80 MHz band); (c) impedance matching (a feature for antennas to gain the matching between the feeder line and the antenna for use in mobile communications across a broad-band); and (d) mechanical structure (a feature for antennas to be simple and easy to manufacture and avoid mechanical errors in the manufacturing process so as not have any major deleterious effect on the antenna characteristics). In the following, each of the above will be discussed.

First, in regard to directional characteristics, the table type antenna 10 is excited in the monopole mode. In other words, the antenna is designed so that it has (a) an axially symmetrical flat-plate, and (b) a plurality of connecting members which electrically connect the flat-plate of the ground plate 20. Thus, desired directional characteristics are obtained.

Next, the achievement of broad-band characteristics. Generally, flat-plate antennas which are excited in the monopole mode have a narrow band width, and the band width can increase to a certain extent by connecting the circular flat or top plate to the ground plate via connecting members and positioning the connecting members inside the edge of the circular plate (that is, closer to the center of the circular plate). However, there are certain limitations in increasing the band width. In view of this difficulty, the present invention is designed so that the band width is increased by installing the strip line resonator 30 inside or under the table type antenna 10 so as to electrostatically couple the resonator 30 with the antenna 10.

Impedance matching will be discussed below. In order to obtain stable excitation in the monopole mode, it is ordinarily necessary to set the feeding point in the central portion of the antenna. However, the central portion of the antenna is of the maximum voltage, and it is difficult to obtain [impedance] matching between the antenna and the feeder line 60. Thus, in the present invention, feeding is accomplished by coupling the table type antenna 10 and the strip line resonator 30 via the electrostatic capacitance Cc. As a result, the impedance of the flat-plate antenna for use in mobile communications and the impedance of the feeder line 60 can be matched by changing the position of the feeding point 50 in the area between the grounded end of the strip line resonator 30 and the capacitor electrode 40. Since the impedance can be matched by changing the position of the feeding pint 50 (or since the position of the tap is changed), no deleterious effect occurs to the antenna in terms of directional characteristics or broad-band characteristics, etc. Thus, an ideal feeding point can be selected easily during the development and design stages of the flat-plate antenna.

Regarding the mechanical structure, the antenna of the present invention is designed so that the table type antenna 10 and strip line resonator 30 are formed separately and then assembled to be combined. Accordingly, the mechanical processing can be accomplished very easily during the manufacture of the antenna. Accordingly, the cost of the antenna is reduced, and as far as ordinary working precision is maintained, there is no deterioration in antenna characteristics or mechanical strength drop of the antenna. If the mechanical dimensional errors occur during the assembly, such errors will result in a change in the coupling capacitance. However, even in such cases, the band width may merely change a little; there would be no essential effect on the antenna characteristics.

Figure 6:
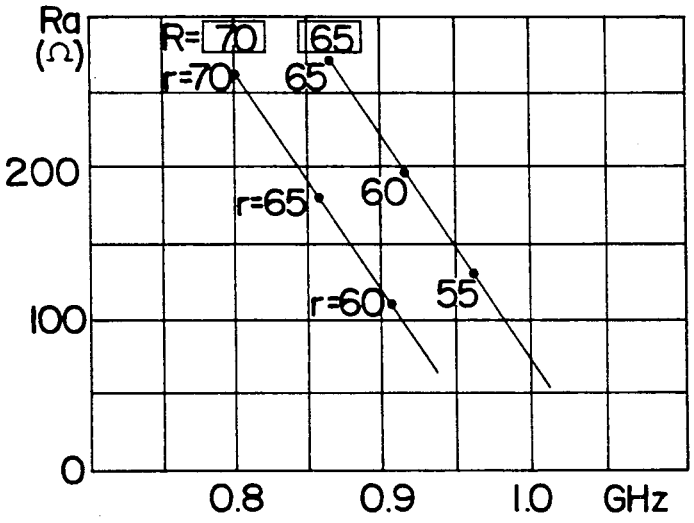
FIG. 6 is a graph which shows the changes in antenna impedance value at the time the antenna resonates when the connecting parts of the antenna are shifted inwardly in the antenna of FIG. 4(1)
Figure 7:
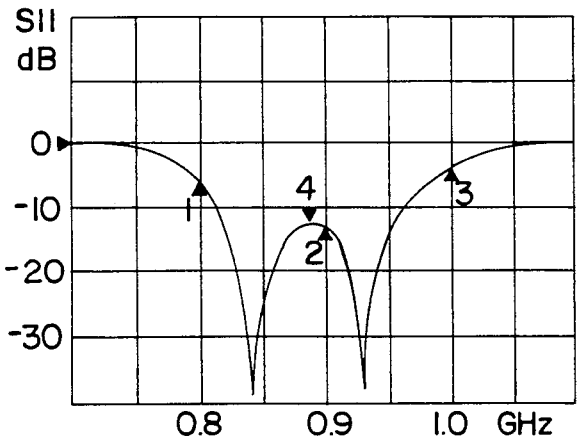
FIGS. 7(1) and 7(2) are graphs each illustrating the reflection loss characteristics and impedance characteristics in the embodiment of FIG. 4(1)
Figure 7:
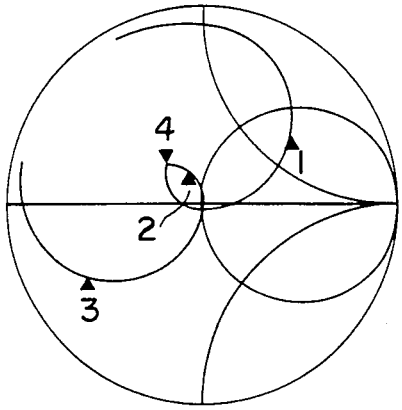

FIG. 6 shows how the antenna impedance value in the case of antenna resonance changes as the connecting members are shifted toward the center of the table type antenna 10. FIG. 7(1) shows measurements of the reflection loss, and FIG. 7(2) shows an example of the impedance characteristics in the form of a Smith chart display.

As to the directional characteristics of radiation of the antenna, when the table-type, flat-plate antenna is resonating in the monopole mode, the direction of the maximum radiation of the antenna is substantially horizontal and is more or less non-directional within the horizontal plane.

Figure 8:
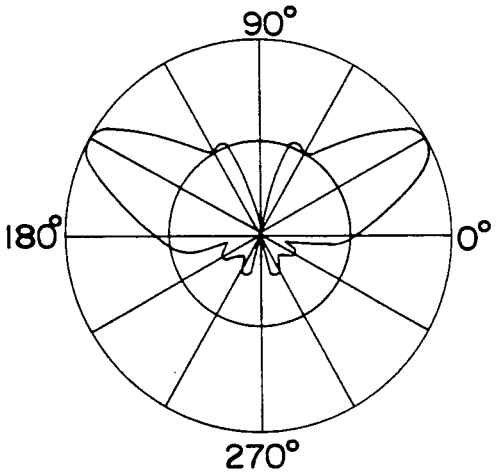
FIG. 8 is a graph illustrating the directional characteristics in the vertical plane in the embodiment of FIG. 4(1).

FIG. 8 shows the directional characteristics measured in a vertical plane where the flat-plate antenna is attached to a circular ground plate of 1.5 m diameter.

Since the ground plate of certain length is used in the embodiment, the characteristics illustrated in FIG. 8 show a directionality oriented slightly upward. If, however, an infinitely large ground plate is used, the directionality would become more or less horizontal.

Figure 4:
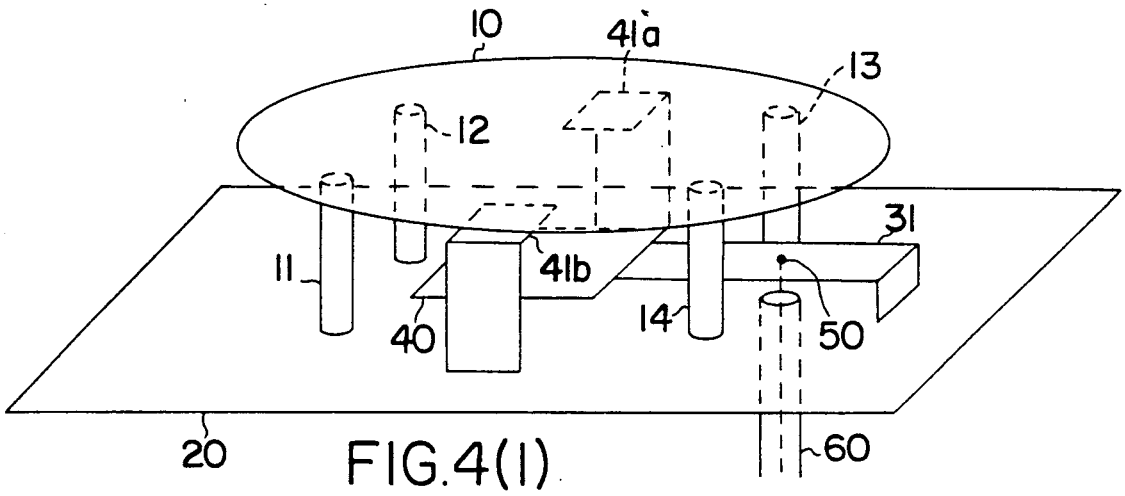
FIG. 4(1) is a perspective view showing another embodiment of the present invention.
Figure 4:
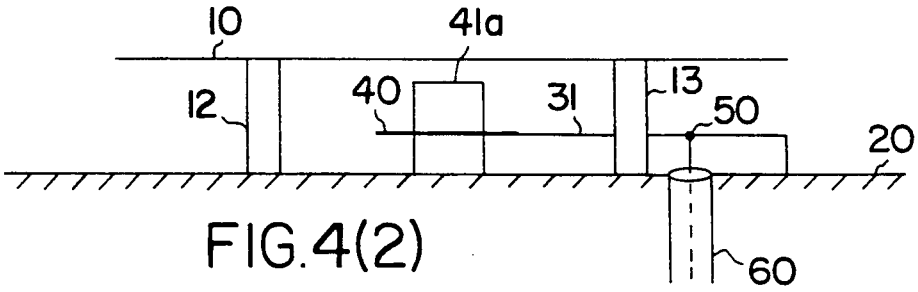
Figure 1:
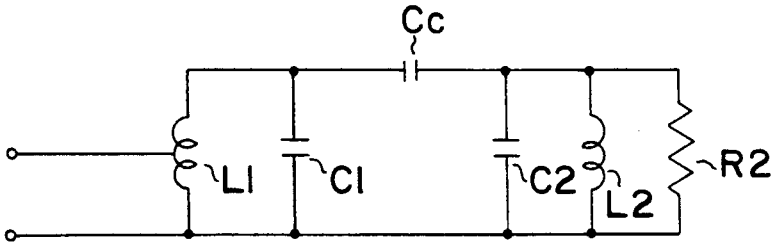

FIG. 4(1) is a perspective view of another embodiment of the present invention, and FIG. 4(2) is a front view thereof with the connecting members 11 and 14 and the capacitor electrode **41*b* in FIG. 4(1)** omitted.

In this embodiment, a strip line resonator 31 is used instead of the strip line resonator 30. The length of the strip line of the resonator 31 is about half that of the strip line of the resonator 30, and only one end of the strip line is grounded or connected to the ground plate 20. In this case as well, the electrode 40 of the condenser is positioned near the center of the table type antenna 10, and an equivalent circuit, which is similar to the circuit shown in FIG. 1(4), is formed.

In this embodiment shown in FIG. 4(1), the strip line resonator resonates at $\lambda/4$ with respect to the frequency used.

Figure 5:
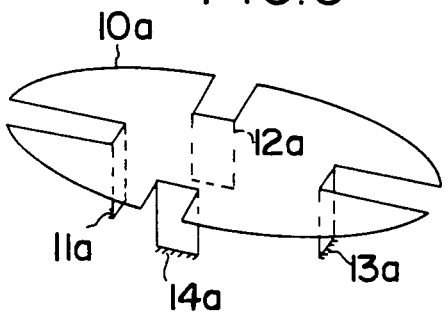
FIG. 5 is a perspective view of a modification of the table type antenna of FIG. 4(1)

FIG. 5 shows a modification of the table type antenna 10.

In this embodiment, the connecting members **11*a*, 12*a* 13*a* and 14*a* are formed by flat plates, and they are installed at prescribed points which are roughly equal distances from the center of the table type antenna 10*a* (not at the edge of the table type antenna 10*a* as are in the previous embodiments). In addition, cut-outs which extend from the edge to the installation positions of the connecting members 11*a* through 14*a* are formed in the table type antenna 10*a***. It is possible to omit these cut-outs.

Furthermore, it would also be possible to construct the table type antenna **10*a***, especially the top plate, in ordinary octagon shape or regular polygonal shape such as hexagonal, etc.

The resonance frequency of the table type antenna can be adjusted by changing the length, width, or diameter of the connecting members. It would also be possible to use three connecting members or five and more connecting members instead of four as in the above described embodiments.

In addition, one of the capacitor electrodes used for table type antenna resonance (i.e., **41*a* or 41*b***) may be omitted, so that only one capacitor electrode is used. Three or more capacitor electrodes can be used as well.

As described in the above, according to the present invention, the antenna as a whole is compact, simple, and has adequate broad-band characteristics.

I claim:

1. A flat-plate antenna for use in mobile communications comprising:

a table type antenna comprising a conductive flate-plate and a plurality of connecting members electrically connecting said flat-plate to a ground plate, a capacitor electrode installed between one of said connecting members and another connecting member and between said flat-plate and ground plate, a strip line resonator installed under said table type antenna and between said top plate and said ground plate; and a capacitor electrode used for strip line resonance installed on said strip line resonator so as to face a central portion of said table type antenna.

2. A flat-plate antenna according to claim 1, wherein both ends of said strip line resonator are grounded, said capacitor electrode used for strip line resonance is installed at approximately a center of said strip line resonator, said strip line resonator as a whole is positioned in a central area inside said table type antenna, and said strip line resonator is caused to resonate at $\lambda/2$ with respect to a frequency used.

3. A flat-plate antenna according to claim 1, wherein one end of said strip line resonator is grounded with the other end left open, said capacitor electrode used for strip line resonance is connected to said open end of said strip line resonator, said strip line resonator as a whole is installed so that said capacitor electrode used for strip line resonance is positioned at a central area inside said table type antenna, and said strip line resonator is caused to resonate at $\lambda/4$ with respect to the frequency used.

4. A flat-plate antenna according to claim 1, wherein a feeding point is provided between a grounded end of said strip line resonator and said capacitor electrode used for strip line resonance.

5. A flat-plate antenna according to claim 1, wherein an impedance of said flat-plate antenna for use in mobile communications and the impedance of a feeder line are matched by varying a position of said feeding point between a grounded end of said strip line resonator and capacitor electrode used for strip line resonance.

6. A flat-plate antenna according to claim 1, wherein said flat-plate of said table type antenna is one of circular and polygon in shape.

7. A flat-plate antenna, according to claim 1, wherein said connecting members are one of rod-form and plate-form conductors.

8. A flat-plate antenna according to claim 1, wherein a resonance frequency of said table type antenna is adjusted by adjusting one of the length, width and diameter of said connecting members.

9. A flat-plate antenna according to claim 1, wherein an impedance value of said antenna during resonance is set at a value required for broad-band characteristics by adjusting a distance between a edge of said flat-plate and said connecting members.

10. A flat-plate antenna according to claim 1, wherein a resonance frequency of said antenna is adjusted by adjusting an electrostatic capacitance of said capacitor electrodes used for table type antenna resonance.

11. A flat-plate antenna according to claim 1, wherein said capacitor used for strip line resonance is set so that an electrostatic capacitive coupling between said table type antenna and strip line resonator is approximately in a state of critical coupling.

12. A flat-plate antenna according to claim 1, wherein said capacitor electrode installed between one of said connecting members and another connecting member is plural in number.

13. A flat-plate antenna for use in mobile communications comprising:

a ground plate;

a table-shape antenna comprising a conductive top plate and a plurality of connecting members which electrically connect said top plate to said ground plate;

a capacitor electrode for resonating said table shape antenna, said electrode being installed between said connecting members and between said top plate and ground plate;

a strip line resonator provided under said table shape antenna and between said top plate and said ground plate; and a capacitor electrode for resonating said strip line resonator, said electrode being provided on said strip line resonator so as to position under a central area of said top plate.

14. A flat-plate antenna according to claim 13, wherein both ends of said strip line resonator are connected to said ground plate and said capacitor electrode on said strip line resonator is located beneath a center of said top plate, said strip line resonator positioned in a central area inside said table shape being caused to resonate at $\lambda/2$ with respect to a frequency used.

15. A flat-plate antenna according to claim 13, wherein one end of said strip line resonator is connected to said ground with other end unconnected, said capacitor electrode used for strip line resonance is connected to an unconnected end of said strip line resonator which is installed so that said capacitor electrode used for strip line resonance is positioned at a central area under said top plate so that said strip line resonator resonates at $\lambda/4$ with respect to a frequency used.

16. A flat-plate antenna according to claim 13, wherein a feeding line is connected to said strip line resonator so that a feeding point is between a grounded end of said strip line resonator and said capacitor electrode used for strip line resonance.

17. A flat-plate antenna according to claim 16, wherein matching of an impedance of said flat-plate antenna and an impedance of said feeder line is obtained by varying a position of said feeding point.

18. A flat-plate antenna according to claim 13, wherein said top plate is provided with cut-outs extending from an outer edge toward a center of said top plate.

* * * * *